US005702760A

United States Patent [19]

Kustermann

[11] Patent Number: 5,702,760

[45] Date of Patent: Dec. 30, 1997

[54] PROCESS FOR COATING RUNNING WEBS

[75] Inventor: Martin Kustermann, Heidenheim, Germany

[73] Assignee: J.M. Voith GmbH, Heidenheim, Germany

[21] Appl. No.: 644,700

[22] Filed: May 10, 1996

Related U.S. Application Data

[60] Continuation of Ser. No. 301,785, Sep. 7, 1994, abandoned, which is a division of Ser. No. 72,330, Jun. 3, 1993, abandoned.

[30] Foreign Application Priority Data

Jun. 5, 1992 [DE] Germany ..... P4218596.3

[51] Int. Cl.[6] ..... B05D 1/28

[52] U.S. Cl. ..... 427/172; 427/211; 427/428; 118/223; 118/227; 118/258

[58] Field of Search ..... 427/172, 211, 427/428; 118/223, 224, 227, 258, 261, 244

[56] References Cited

U.S. PATENT DOCUMENTS

| | | | |
|---|---|---|---|
| 2,352,658 | 7/1944 | Richmond et al. | 427/211 |
| 4,147,126 | 4/1979 | Riggs | 118/227 |
| 4,250,211 | 2/1981 | Damrau et al. | 427/356 |
| 4,407,227 | 10/1983 | Mauranen | 118/642 |
| 4,774,107 | 9/1988 | von Kwiatkowski et al. | 427/211 |
| 4,823,730 | 4/1989 | Fleissner | 118/223 |
| 4,848,268 | 7/1989 | Sollinger et al. | 118/227 |
| 4,878,981 | 11/1989 | Mizutani | 156/356 |
| 5,203,920 | 4/1993 | Plomer | 118/206 |
| 5,368,893 | 11/1994 | Sommer et al. | 427/428 |

FOREIGN PATENT DOCUMENTS

| | | |
|---|---|---|
| 0453427 | 4/1991 | European Pat. Off. . |
| 00596 | 3/1991 | WIPO . |

*Primary Examiner*—Katherine A. Bareford
*Attorney, Agent, or Firm*—Baker & Daniels

[57] ABSTRACT

A coating system for material webs, specifically of paper or cardboard, includes two mutually parallel rolls directly coordinated with each other, the rolls having a mutually variable spacing such that the rolls can be positioned to create a press gap for coating the web, or so as not to create a press gap. When the rolls are not positioned to form a press gap, the web passes over both roll shells while circumventing the applicators which have already dosed the roll shells with a coating mixture. The web passes over both roll shells for purposes of transferring the coating mixture predosed by the applicators. Solely the web pull in conjunction with the wrap angle of the two roll shells serves the final dosing by scraping off an excess quantity from the roll shells.

8 Claims, 2 Drawing Sheets

PROCESS FOR COATING RUNNING WEBS

This is a continuation of application Ser. No. 08/301,785, filed Sep. 7, 1994, now abandoned, which is a divisional application of Ser. No. 08/072,330, now abandoned, filed Jun. 3, 1993.

BACKGROUND OF THE INVENTION

The invention concerns a coating system for material webs such as paper or cardboard which includes two mutually parallel rolls, directly coordinated with each other, and with a mutually variable spacing that allows a press gap for coating of the web to be created.

These coating systems frequently have established themselves today, generally for papers which must not satisfy maximum requirements. Expected of these systems, however, is a great variability, providing different coatings for different purposes of the web. These different coatings are provided by means of a specific arrangement of the manner in which the rolls are coordinated with one another and arranged movably in relation to one another, such as in the German application P 40 14 647.2, and coordination of different applicators with the individual rolls. In order for the coating system to provide such variability, however, the web threading of the system may involve problems in threading the web in the system start-up, or during restart after web breakage. Web threading by means of the usual rope carriers may prove to be rather difficult.

The problem underlying the invention, therefore, is to provide a variable coating system with a relatively simple web threading.

SUMMARY OF THE INVENTION

In the arrangement of the present invention the two mutually coordinated rolls are arranged in specific selected horizontal planes, thereby making it possible to provide in an easy and simple manner applicators for effecting the roll shell coating for all of the contemplated cases of coating.

On the other hand, the contact pressure of the web onto the roll shell can be adjusted by a specific adjustability of the mutual roll spacing, so as to control the coating mixture dosing by the web through its contact force on the roll shell. The application by the applicators is not directly on the web itself, but first on the roll shells. This is always true, also in the case of forming a press gap between the two rolls through which the web is passed in order to be provided, preferably on both sides, with the coating application.

BRIEF DESCRIPTION OF THE DRAWINGS

The invention will be explained hereafter with the aid of the embodiments illustrated in the figures, all of which show basic views.

DESCRIPTION OF THE PREFERRED EMBODIMENTS

Figure 1:
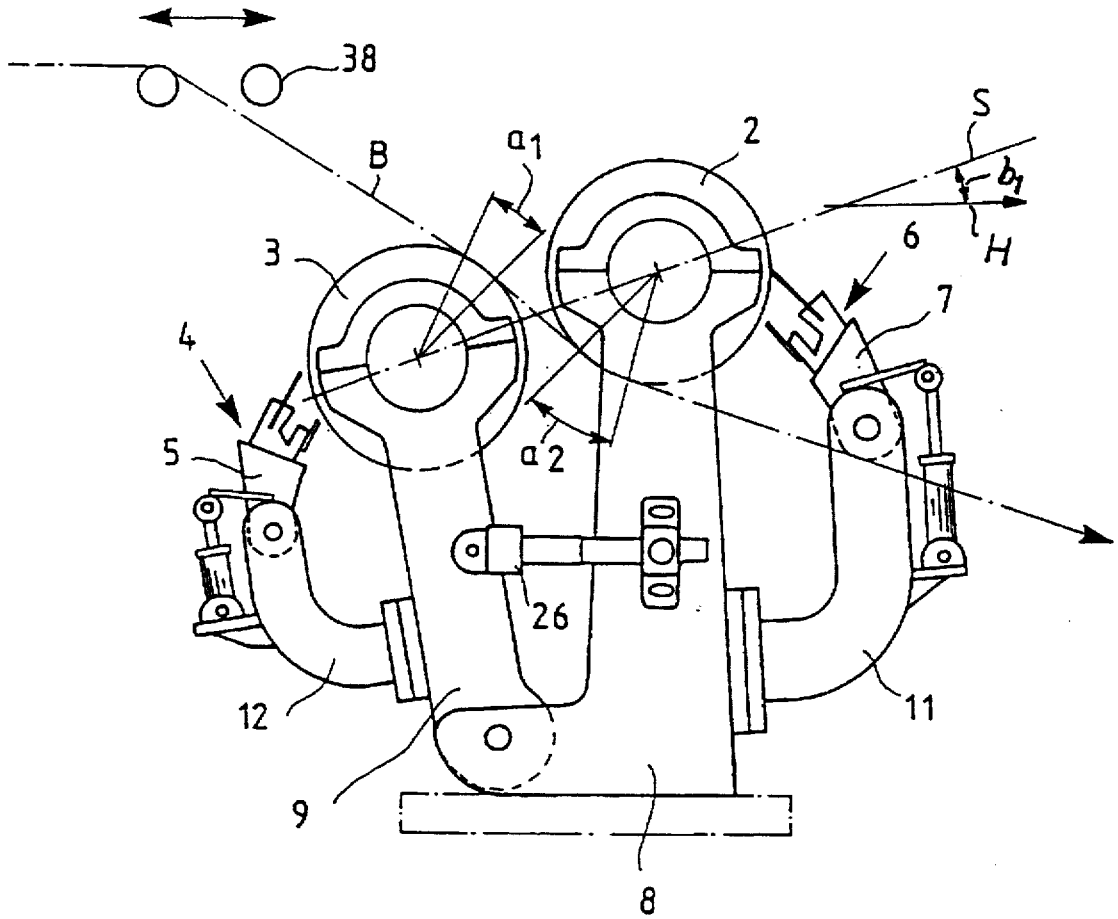
FIG. 1 shows a side view of one embodiment of the present invention.

FIG. 1 illustrates an arrangement of two mutually parallel rolls 2 and 3 with their coordinated applicators 4 and 6, which are so-called nozzle applicators. Applicators 4 and 6 are preferably in the lower range of rolls 2 and 3. Here, the rolls are provided with a height position such that the connecting plane S of their axes of rotation is inclined at an angle b1 between 0° and 45° with respect to the horizontal H. The web B preferably runs from the top obliquely down, reaching the bottom roll 3 first. This is in most cases a favorable arrangement for the rolls 2 and 3, which in the chosen embodiment have separate columns 8 and 9. Column 8 of the roll 2 is fixed on the foundation, whereas column 9 for the roll 3 is mounted on column 8 of the roll 2 in a pivotable fashion about an axis which is parallel to the rolls. The nozzle applicators 4, 5, and 6, 7 are respectively held, each in a pivotable fashion, on extension arms 11 and 12 of the columns 8 and 9. The nozzle applicators are of a generally known design, and derive basically from the U.S. Pat. No. 4,250,211.

The relative position of the two rolls can be exactly controlled by a spindle mechanism 26 coupling the two columns 8 and 9 of the rolls on the two ends of spindle mechanism 26. This spindle mechanism may employ an electrical stepper motor which enables a very exact positioning. The course of the web can be extensively changed in that an existing reversing roll 38, which preferably may be designed as an expander drum, is operable in a horizontally adjustable fashion over a wide range. This makes it possible to also move the web in a favorable position for the case wherein rolls 2 and 3 are close to each other and form between themselves a press gap through which the web is passed for coating, preferably on both of its sides.

Both for the illustrated case of the spaced rolls, i.e., the two rolls not making contact with each other with no paper in between or in other words not positioned to form a press gap, and for the indicated case of the press gap between the two rolls, the application of coating mixture by the applicators 4, 5, or 6, 7, takes place first on the roll shell(s). In the illustrated case of the spaced rolls, the web pull or the contact force of the web provides the dosing force and, accordingly, determines the amount of coating mixture remaining on the web. The entered wrap angles $\alpha_1$ and $\alpha_2$ are at constant web pull a measure for the dosing force. It can be adjusted very sensitively for both sides of the web by the adjustment options shown. The wrap angles $\alpha_1$ and $\alpha_2$ may be equal or differ from each other; preferable magnitudes of the wrap angles should be chosen between 2° and 35° for $\alpha_1$ and between 10° and 40° for $\alpha_1$. The sum of both angles may amount to between 10° and 70°, and preferably between 25° and 55°.

Figure 2:
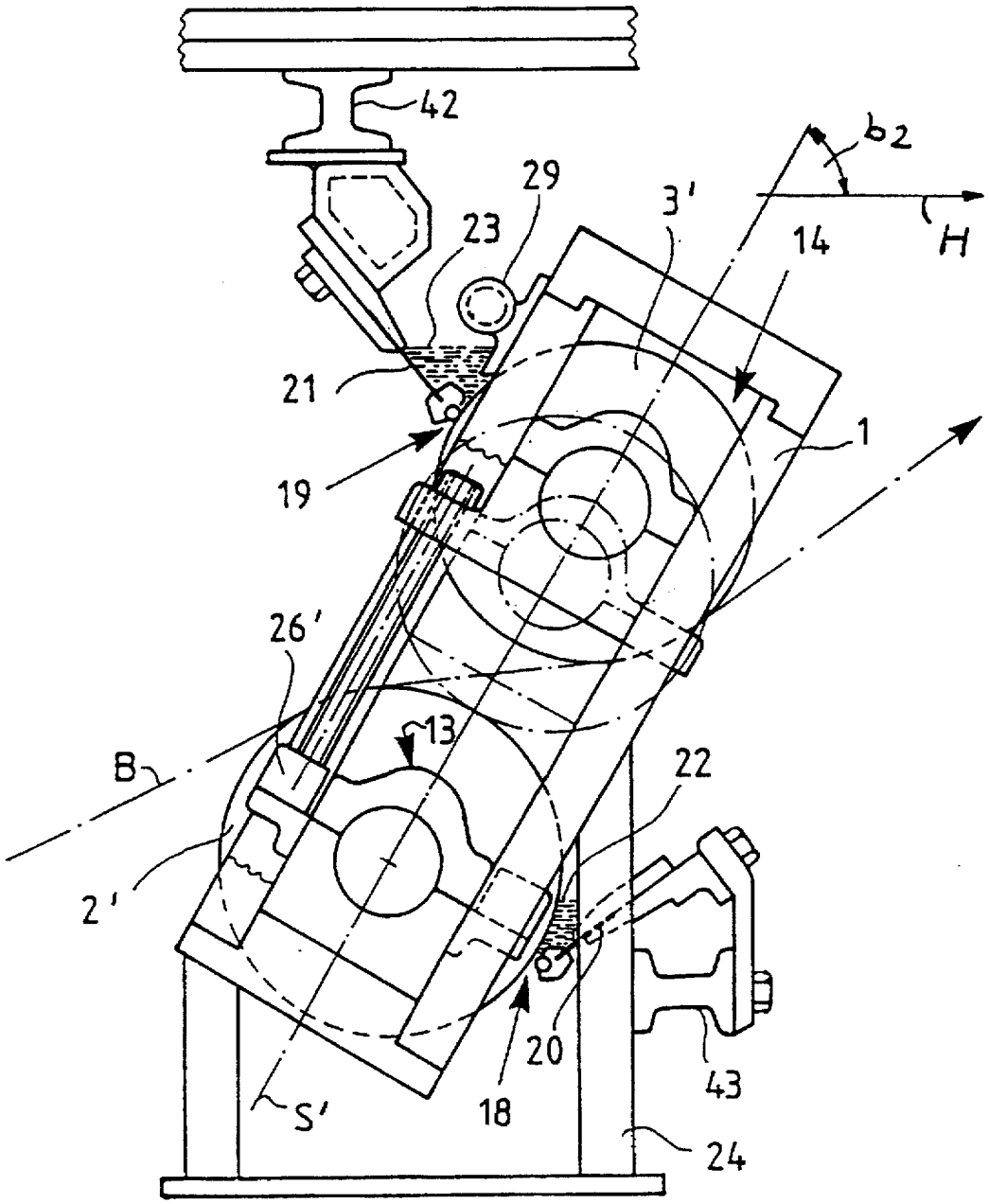
FIG. 2 shows a side view of another embodiment of the present invention.

Illustrated in FIG. 2 is a second embodiment with rolls arranged more superposed, and where nozzle applicators other than those of FIG. 1 are preferably used. Here, the rolls 2' and 3' are arranged more superposed, and the angle b2 of the connecting plane S' of their axes of rotation to the horizontal H preferably amounts to between 60° and 90°. A web course is possible here both obliquely upward from the bottom and obliquely down from the top. The two rolls 2' and 3' are mounted on their ends in a rigid frame 1 by means of bearings 13 and 14. The bearing 14 of the upper roll 3' is arranged so as to be movable, by means of adjustment device 26', in a slideway. The adjustment device here is also preferably an electrically driven spindle mechanism. The rigid frame 1 bears on a column 24 on the foundation. Used as applicators here are dosing slats or doctor elements 18 and 19, which form a coating mixture sump preferably with flexible holders 20 and 21. The coating mixture (sizing or pigmented binder) sumps are referenced 22 and 23. Each sump is supplied via a distributing pipe 29. These applicators can readily be hung on any kind of carrying device (for instance carriers 42 and 43), and are each preferably in the upper range of rolls 2' and 3'. The applicator of the lower roll 2', of course, may also be a nozzle applicator. Otherwise, conditions are similar to those in the case of FIG. 1.

It is evident that both embodiments feature a very simple web threading, and an easy rope carrier option for threading of the threading strip in start-up is obtained by incorporating the guide roll 38, or 38', in the rope carrier system.

Overall, the following also is thus accomplished: a double-sided coating of the web is made possible with a minimal application, with a very slight amount of applied coating mixture being transferred on the web in the press gap between the two rolls; in the other case of dosing by means of web pull, pigmented coating mixture can be applied in a sufficient amount on the web surface without excessive penetration of the web. When dosing by means of web pull the pigment shares will chiefly act toward refinement of the web surface. The dosing by means of web pull also gives an exact dosing for both web sides due to the variable adjustment option of the mutual roll spacing.

Special attention may also be devoted to the velocity control to enable a flawless working both in the operation of the press gap and in the dosing by means of web pull. In the changeover from dosing by web pull to the operation with press gap, the web must not break as the gap is being closed. For this reason the peripheral speed of the roll shells must then approximately match the web speed. On the other hand, when working with a gap between the rolls, their speeds may be relatively different from each other. Specifically, they may be higher or lower than the web speed. With the peripheral speed of the first roll reached by the web being $v_1$, that of the other roll being $v_2$, and the speed of the web being $v_b$, the following ratios should be considered as favorable: $v_2/v_1$ , or $v_1/v_b$=0.8:1 to 1.2:1, preferably 1.02:1 to 1.15:1. Moreover, when $v_2$ is higher than $v_1$ and both are higher than $v_b$, the following ratios should be considered as favorable: $v_2/v_1$, =1:1 to 1.2:1, and preferably 1.02:1 to 1.15:1.

The gap between the two rolls can be either manually or automatically adjustable independently of the web pull. Suitable ranges are 0.02 to 300 mm, and preferably 5 to 100 mm.

The reversing pulley 38, of course, is also a place via which the course of the rope for threading of the web must extend. Thus, the reversing pulley has an appropriate rope track or sheave.

What is claimed is:

1. A process for applying a coating to each side of a running web, comprising the steps of:

providing two mutually parallel rolls, each roll having a shell, the rolls being directly coordinated with each other and having a mutually variable spacing for passing the running web therebetween, such that the rolls can be positioned to create a press gap for coating the web, and can be positioned so as not to form a press gap, positioning the two rolls to not form the press gap, applying a dosing of coating mixture to the respective shells of each of the rolls, and dosing the coating mixture from each of said roll shells onto the respective side of the running web by having the web scrape off a surplus quantity of coating mixture from each respective roll shell, wherein the web contacts each said roll at a wrap angle and at a contact force, wherein the dosing on each of said web sides, due to a variable wrap angle of the roll shells by the web, occurs at a constant web pull through the contact force of the web onto the roll shells, which adjusts in a range of the wrap angle.

2. The process of claim 1, wherein the two mutually parallel rolls comprise a first roll and a second roll, and wherein the first roll is first reached by the running web during said coating process and the second roll is reached by the running web during said coating process after the web reaches the first roll, wherein said rolls, when positioned to not form the press gap, each have a peripheral speed higher or lower than a peripheral speed of the web, and wherein a ratio of the peripheral speed of the second roll to the peripheral speed of the first roll is between 0.8:1 and 1.2:1.

3. The process of claim 2, wherein the ratio is between 1.02:1 and 1.15:1.

4. The process of claim 2, wherein each of the first and second rolls has a higher peripheral speed than the web, and wherein the ratio of the peripheral speed of the second roll to the peripheral speed of the first roll is between 1:1 and 1.2:1.

5. The process of claim 4, wherein the ratio is between 1.02:1 and 1.15:1.

6. The process of claim 2, wherein the ratio of the peripheral speed of the first roll to the peripheral speed of the web is between 0.8:1 and 1.2:1.

7. The process of claim 2, wherein the ratio of the peripheral speed of the first roll to the peripheral speed of the web is between 1.02:1 and 1.15:1.

8. A process for applying a coating to each side of a running web, comprising the steps of:

providing a coating system comprising two mutually parallel rolls, each of said rolls having a shell and having a respective applicator means coordinated therewith for dosing a coating mixture on said roll, said coating system further comprising means for adjusting a spacing between said mutually parallel rolls, wherein the rolls can be selectively positioned to create a press gap, and so as not to create a press gap, when the running web is passed between said rolls during said coating process;

adjusting the spacing between said rolls so as not to form a press gap;

applying a dosing of coating mixture from the respective applicator means to each of said roll shells; and dosing the coating mixture from each of said roll shells onto the respective side of the running web by having the web scrape a quantity of said coating mixture from each respective roll shell, wherein the web contacts each said roll shell at a wrap angle and at a contact force, wherein the dosing on each of said web sides occurs at a constant web pull through the contact force of the web onto the respective roll shell, said wrap angle and said contact force being variable by adjusting said spacing between said rolls such that the dosing on each of said rolls may be selectively controlled.

* * * * *